US008424253B2

(12) United States Patent
Loewen et al.

(10) Patent No.: US 8,424,253 B2
(45) Date of Patent: Apr. 23, 2013

(54) SEISMIC AND IMPACT MITIGATION DEVICES AND SYSTEMS

(75) Inventors: Eric P. Loewen, Wilmington, NC (US); Brett J. Dooies, Wilmington, NC (US)

(73) Assignee: GE-Hitachi Nuclear Energy Americas LLC, Wilmington, NC (US)

( * ) Notice: Subject to any disclaimer, the term of this patent is extended or adjusted under 35 U.S.C. 154(b) by 5 days.

(21) Appl. No.: 12/979,855

(22) Filed: Dec. 28, 2010

(65) Prior Publication Data

US 2012/0159876 A1 Jun. 28, 2012

(51) Int. Cl.
*E04H 9/02* (2006.01)

(52) U.S. Cl.
USPC ..... 52/167.4; 52/167.6; 52/169.9

(58) Field of Classification Search ..... 52/167.1–167.8, 52/1, 169.1, 169.8, 169.9; 248/636, 638, 248/565
See application file for complete search history.

(56) References Cited

U.S. PATENT DOCUMENTS

| | | | | |
|---|---|---|---|---|
| 2,035,009 | A * | 3/1936 | Rager | 52/167.4 |
| 3,748,800 | A * | 7/1973 | Glicksberg | 52/167.4 |
| 4,179,104 | A * | 12/1979 | Skinner et al. | 267/154 |
| 4,266,379 | A * | 5/1981 | Valencia Aguilar | 52/1 |
| 4,527,365 | A * | 7/1985 | Yoshizawa et al. | 52/167.8 |
| 4,587,773 | A | 5/1986 | Valencia | |
| 5,797,227 | A * | 8/1998 | Garza-Tamez | 52/167.1 |
| 6,085,472 | A * | 7/2000 | Malhotra | 52/167.4 |
| 6,499,170 | B2 * | 12/2002 | Kim et al. | 14/73.5 |
| 6,557,306 | B1 * | 5/2003 | Sekiya et al. | 52/30 |
| 7,234,277 | B2 * | 6/2007 | Savin | 52/79.12 |
| 2003/0150172 | A1 * | 8/2003 | Valencia | 52/167.2 |
| 2007/0283635 | A1 * | 12/2007 | Lee et al. | 52/167.7 |
| 2008/0098670 | A1 * | 5/2008 | Hsu | 52/167.1 |
| 2008/0229684 | A1 * | 9/2008 | Joung et al. | 52/167.4 |
| 2009/0056243 | A1 * | 3/2009 | Sneed | 52/167.8 |
| 2009/0211179 | A1 * | 8/2009 | Willford | 52/167.1 |

FOREIGN PATENT DOCUMENTS

CA 1 206 981 A1 7/1986

(Continued)

OTHER PUBLICATIONS

Blandford et al., "Advanced Seismic Base Isolation Methods for Modular Reactors", Depts. of Civil and Environmental Engineering and Nuclear Engineering, University of California, Berkeley, California, Sep. 30, 2009.

(Continued)

*Primary Examiner* — Brian Glessner
*Assistant Examiner* — Beth Stephan
(74) *Attorney, Agent, or Firm* — Harness, Dickey & Pierce, P.L.C.

(57) ABSTRACT

Systems mitigate structural damage by selectively engaging energy-absorbing structures only during impact events, including aircraft impacts. Systems include lateral dampening devices and/or seismic bearings between a structure and its foundation. Lateral dampening devices include a restorative member and/or reactive member configured to rigidly join the structure and the foundation and dampen reactive movement after the structure moves toward the foundation during an impact event. Seismic bearings include a top plate connected to the structure, a bottom plate connected to the foundation, and a resistive core between the top plate that dampens relative movement between the structure and the foundation. Seismic bearings may include a capture assembly that rigidly joins and dampens reactive movement between the structure and the foundation during an impact event. The structure may further include a ledge into which the top plate seats and dampens reactive movement between the structure and the foundation during an impact event.

23 Claims, 7 Drawing Sheets

FOREIGN PATENT DOCUMENTS

| | | | | |
|---|---|---|---|---|
| FR | 2 544 432 | A1 | | 10/1984 |
| FR | 2 738 861 | A1 | | 3/1997 |
| JP | 09235890 | | * | 9/1997 |
| WO | 2005/106148 | A1 | | 11/2005 |
| WO | 2008/049836 | A2 | | 5/2008 |

OTHER PUBLICATIONS

International Search Report issued in connection with PCT US2011/063641, Jun. 19, 2012.

* cited by examiner

SEISMIC AND IMPACT MITIGATION DEVICES AND SYSTEMS

BACKGROUND

Nuclear reactors use a variety of damage prevention/mitigation devices and strategies to minimize the risk of, and damage during, unexpected or infrequent plant events. An important aspect of risk mitigation is prevention of plant damage and radioactive material escape into the environment caused by seismic events. Various seismic risk mitigation devices and analyses are used to ensure that the containment building is not breached, and that other plant damage is minimized, during seismic events.

A known seismic damage and risk mitigation device is a seismic bearing used in building foundations. FIG. 1A is an illustration of a conventional seismic bearing 10 useable in nuclear plants and other buildings and structures to reduce damage from earthquakes. As shown in FIG. 1A, seismic bearing 10 includes an upper plate 15 and lower plate 16 separated by an energy-absorbing and restorative core post 12, which may be surrounded by another similar material or materials, such as an elastic rubber annulus 11 and stiffening plates 13. Lower plate 16 may be attached to a building foundation or ground under the building, while upper plate 15 may be attached to the actual building structure.

As shown in FIG. 1B, when lower plate 16 vibrates or moves during an earthquake, the core post 12, annulus 11, and/or stiffening plates 13 may absorb vibratory energy and permit nondestructive relative movement between upper plate 15 and lower plate 16, and thus building and ground. Although conventional seismic bearing 10 is shown as a known rubber bearing design, other known core materials and resistive plate separators are useable therein. Any number of seismic bearings 10 may be used in combination at a base of a building in order to provide a desired level of seismic protection.

SUMMARY

Example embodiments provide systems for mitigating structural damage from impact events, including aircraft strikes. Example systems include lateral dampening devices in between a side of a structure to be protected and a stationary lateral foundation and/or seismic bearings in between a base of the structure and a base foundation.

Example embodiment lateral dampening devices may be equally spaced along the side of the structure and/or the lateral foundation and include a restorative member and a reactive member configured to rigidly join the structure and the lateral foundation and dampen reactive movement when the structure initially moves toward the lateral foundation during a non-earthquake event such as an aircraft impact. The restorative member may include a spring, and the reactive member may include a biasing surface and hook oppositely positioned so as to rigidly engage when the structure moves the distance.

Example embodiment seismic bearings may include a top plate connected to the base of the structure, a bottom plate connected to the base foundation, and a resistive core between the top plate and the bottom plate that dampens relative movement between the structure and the base foundation. Example embodiment seismic bearings may include a capture assembly that rigidly joins and dampens reactive movement between the structure and the base foundation in a first direction after the structure moves during an airplane impact. The capture assembly may include an inner shaft connected to the top plate, an outer shaft vertically slidably attached to the inner shaft in a vertical direction, a hook on the outer shaft, a differentiating post attached to the resistive core, and a stationary hoop rigidly attached to the base foundation. The outer shaft may rest on the differentiating post until the structure moves during the impact event, when the outer shaft drops down so that the hook engages the stationary hoop.

The structure may further include a ledge about example embodiment seismic bearings and the top plate may seat into the ledge and dampen reactive movement between the structure and the base foundation during an aircraft impact. Example embodiments may be used in any number and combination in example systems, and example embodiments may be used to protect a variety of structures from both seismic and impact events, including a containment building of a nuclear reactor.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION

Figure 1A:
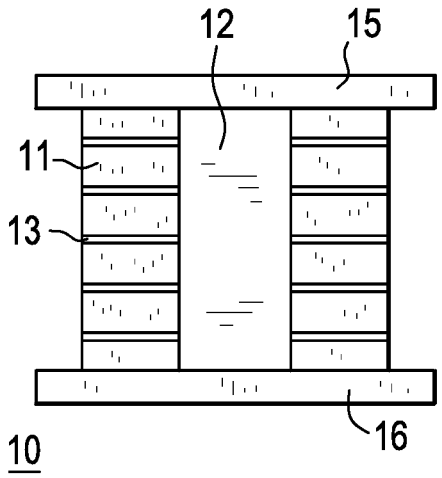
FIG. 1A (Conventional Art)
FIGS. 1A and 1B are illustrations of a conventional seismic bearing.

Detailed illustrative embodiments of example embodiments are disclosed herein. However, specific structural and functional details disclosed herein are merely representative for purposes of describing example embodiments. For example, although example embodiments may be described with reference to a Power Reactor Innovative Small Modular (PRISM), it is understood that example embodiments may be useable in other types of nuclear plants and in other technological fields. The example embodiments may be embodied in many alternate forms and should not be construed as limited to only example embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected," "coupled," "mated," "attached," or "fixed" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the language explicitly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

The inventors have recognized that conventional seismic events, such as earthquakes, addressed by existing seismic isolation devices and mitigation strategies may not adequately address or reduce risks posed by other large-scale events such as explosions or direct airplane strikes on structures, including nuclear power plants. The Sep. 30, 2009 publication "Advanced Seismic Base Isolation Methods for Modular Reactors" by Blandford, Keldrauk, Laufer, Mieler, Wei, Stojadinovic, and Peterson at the University of California, Berkeley Departments of Civil and Environmental and Nuclear Engineering (hereinafter "UCB Report") is herein incorporated by reference in its entirety. As shown in the UCB Report, aircraft strikes by commercial-scale airplanes and other massive impact events on reinforced structures, such as large-scale buildings, storage sites, and commercial nuclear reactor containment buildings, may produce significantly different reactions in these structures, compared to typical responses from various types of earthquakes.

Figure 2A:
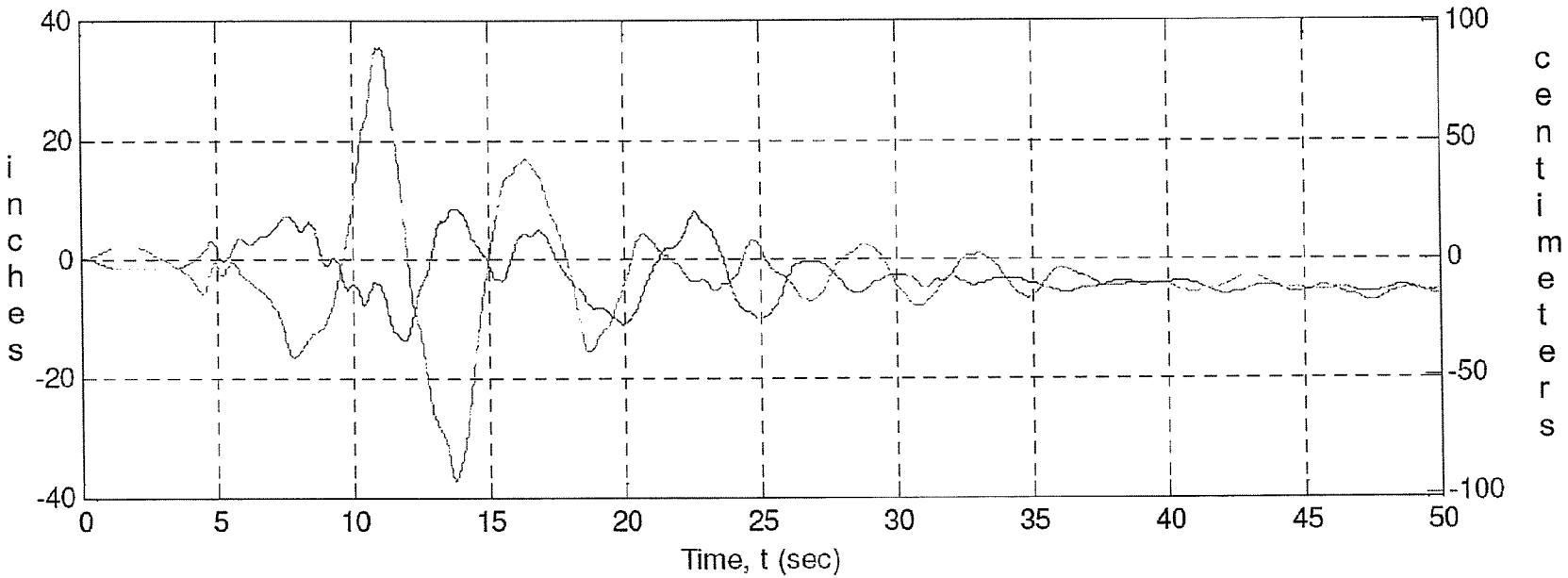
FIG. 2A is a graph of structure base movement during a typical earthquake event.
Figure 2B:
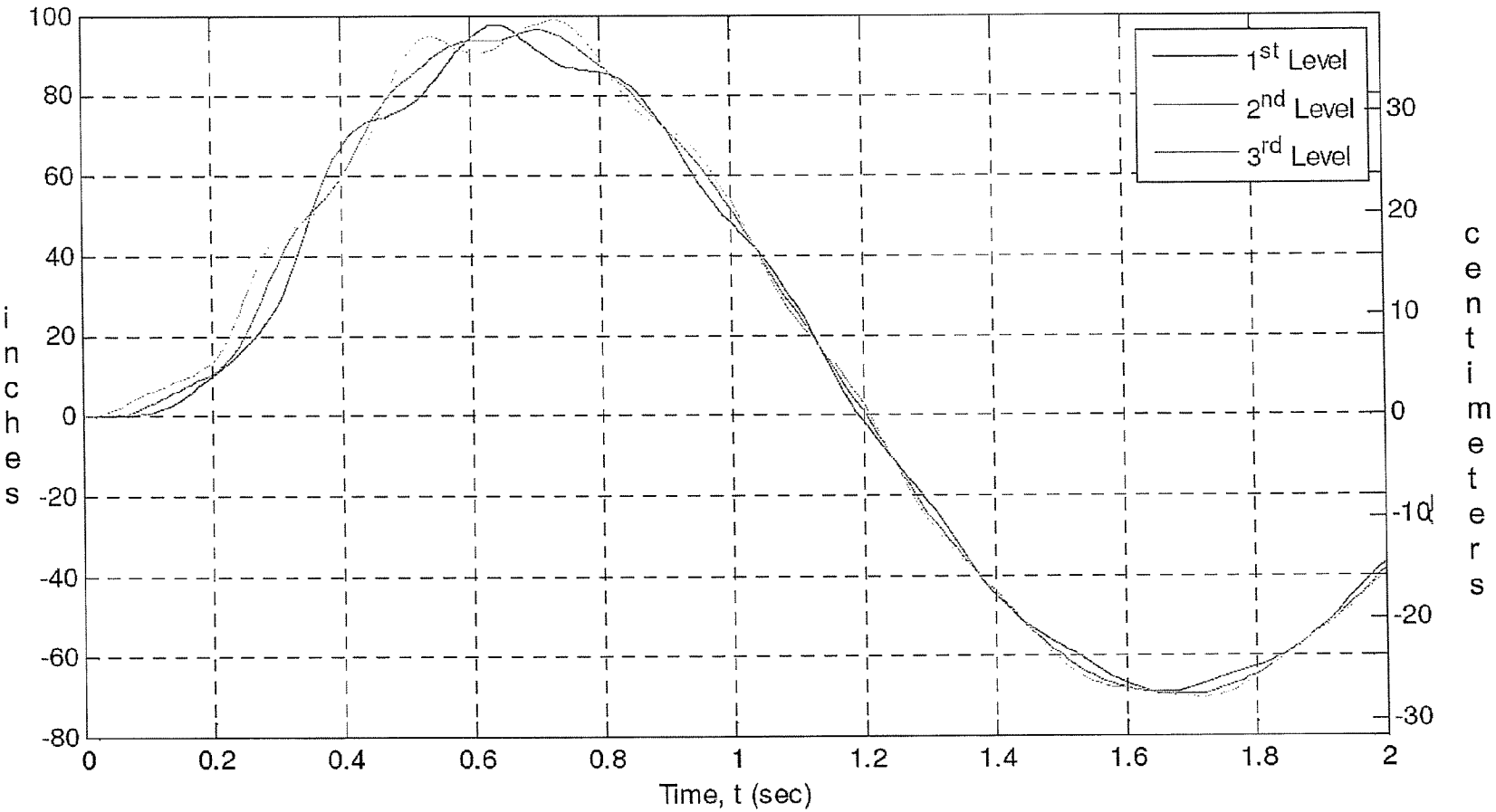
FIG. 2B is a graph of structure level movement during a simulated aircraft impact event.

FIG. 2A is a graph of base level movement in a modular structure subjected to the 1978 Tabas, Iran earthquake, whereas FIG. 2B is a graph of base, middle, and upper floors in the modular structure (a PRISM containment building) subjected to a simulated direct Boeing 747-400 impact on a lateral, exterior surface of the modular structure, taken from the UCB report. As shown in FIG. 2A, the earthquake causes a maximum displacement of approximately 15 inches well into the earthquake event, but the aircraft strike, shown in FIG. 2B, causes a maximum displacement of approximately 100 inches almost immediately into the impact event.

Further, as shown in FIG. 2A, the earthquake lasts for several seconds and imparts several oscillating movements of increasing then decreasing magnitude to the modular structure base level, but the aircraft strike, shown in FIG. 2B, lasts for only a few seconds after impact and imparts a single, large-magnitude initial displacement followed by a single, large, reactive, rebound in the opposite direction.

The inventors have recognized that the difference in earthquake and impact scenario structure reactions may render conventional seismic devices and countermeasures ineffective in the instance of a large aircraft crash into a modular structure like a high-rise building, storage silo, or nuclear reactor containment building, for example. The inventors have further recognized that the characteristic difference in onset, magnitude, and number of floor displacements between impact events and earthquakes permits selective and specialized approaches to mitigate the unique damage caused by either event. Example embodiment devices and systems discussed below specifically take advantage of the differences in these events discussed in the UCB report so as to reduce or prevent damage to buildings from both earthquakes and aircraft strikes or other impact events.

Figure 3:
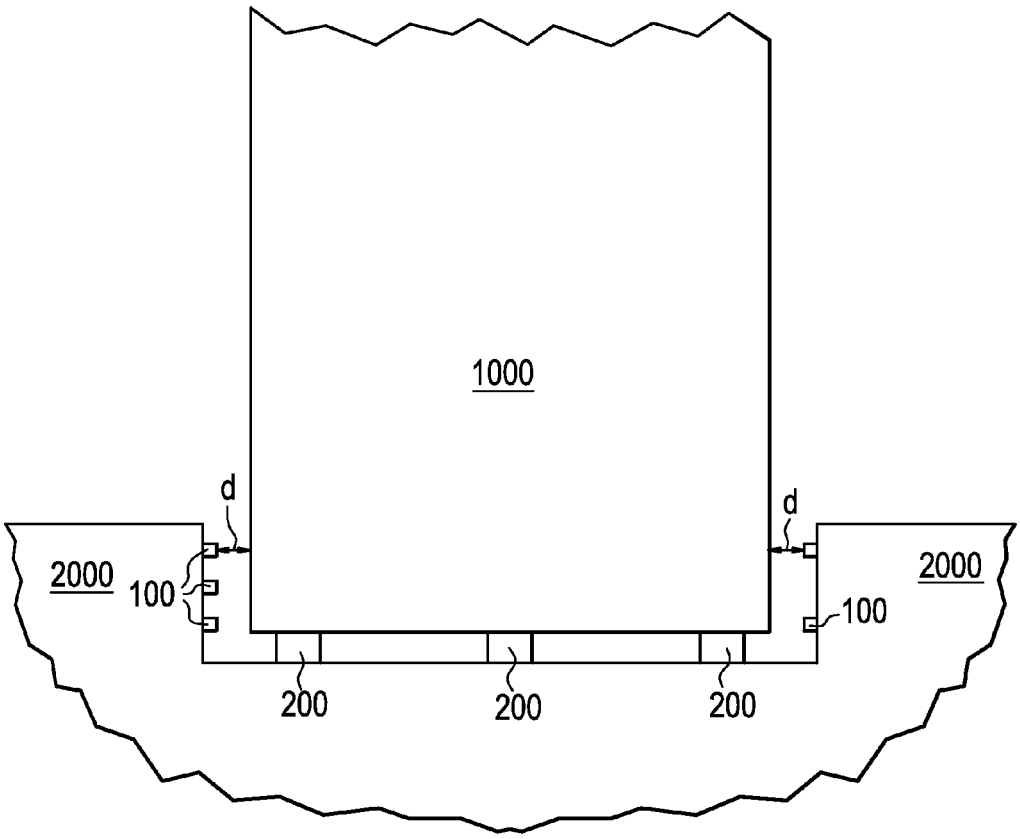
FIG. 3 is an illustration of an example embodiment aircraft strike mitigation system.

FIG. 3 is an illustration of an example embodiment system for protecting a structure from an earthquake and/or large aircraft impact. As shown in FIG. 3, a structure 1000 may be partially embedded in foundation 2000. It is understood that structure 1000 may alternatively be placed on a relatively flat or partially-enclosing foundation. Structure 1000 may be any type of large modular building susceptible to earthquake or impact damage, including a high-rise building, a reinforced storage silo, a containment building for a conventional or PRISM nuclear reactor, a military shelter or bunker, etc. Foundation 2000 may be any type of conventional structural foundation, including reinforced concrete, bedrock, packed soil and/or other nearby stationary structures, for example.

The example embodiment system shown in FIG. 3 includes one or more example embodiment devices that prevent or reduce damage to structure 1000 in earthquake and impact events, including the airplane collisions depicted in the UCB Report. For example, as shown in FIG. 3, several lateral dampening devices 100 may be placed in or on lateral surfaces of foundation 2000 to reduce movement and absorb energy from structure 1000 nearing lateral surfaces of foundation 2000. Example embodiment lateral dampening devices 100 may be placed at desired vertical and/or circumferential positions so as to receive and evenly dampen movement in structure 1000 from several different directions with appropriate force. Because an aircraft strike may cause sudden and extreme structure displacement and correction, as described in the UCB Report, example embodiment lateral dampening devices 100 may be spaced a known displacement d from structure 1000 and configured to receive and dampen motion based on the mass of structure 1000 and aircraft strike momentum. For example, displacement d may be over 50 inches, such that example embodiment dampening devices 100 are contacted and engaged only during an aircraft impact event causing larger movement of structure 1000, but not during an earthquake event causing smaller repetitive movements in structure 1000 that may not require lateral dampening and energy absorption.

Example embodiment lateral dampening devices 100 may include several different structures that nondestructively absorb initial energy and dampen immediate movement of structure 1000. For example, lateral dampening devices 100 may include bundles of heavy duty springs having a spring constant sufficient to absorb/resist initial movement in structure 1000 upon contact, without significantly damaging the same upon contact. When placed about opposite positions of structure 1000, example embodiment lateral dampening devices 100 including springs may absorb energy from, and reduce a magnitude of, both initial structure 1000 displacement and subsequent reactive displacement of structures, as shown in the UCB Report. Alternately or additionally, lateral dampening devices may include plastics, rubber, foams, airbags, and/or any other structure that can absorb/resist movement in structure 1000 upon displacement. Example embodiment lateral dampening devices 100 may include additional structures and functions, discussed below, to reduce any additional reactive movement caused by springs or other absorbing structures in example embodiment lateral dampening devices 100. Example embodiment seismic bearings 200, discussed below, may further reduce any additional reactive movement of structure 1000 in combination with example embodiment lateral dampening devices 100 useable in example embodiment seismic mitigation systems.

Figure 4:
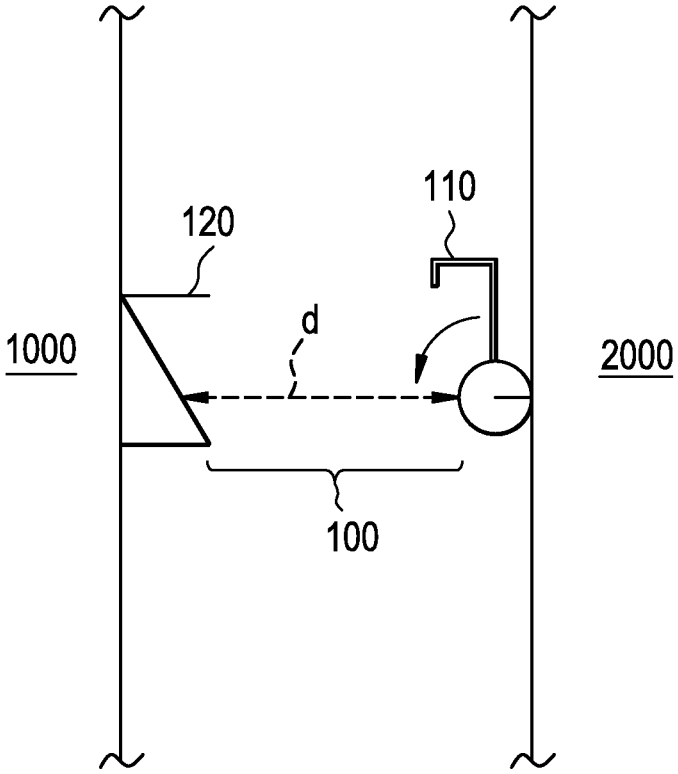
FIG. 4 is an illustration of an example embodiment lateral dampening device.

Example embodiment lateral dampening devices 100 may include several different structures nondestructively absorbing reactive energy and dampening reactive movement of structure 1000. For example, as shown in FIG. 4, example embodiment lateral dampening device 100 may include a biasing member 120 and a reactive member 110 placed in opposing positions on structure 1000 and foundation 2000 or vice versa. As shown in FIG. 4, when structure 1000 is displaced a distance d following an impact event such as a lateral airplane crash, reactive member 110 may engage biasing member 120 to prevent or dampen subsequent reactive displacement of structure 1000. For example, biasing member 120 may include a sloped surface that, when contacted with reactive member 110, causes reactive member 110 to rotate and engage a hook with a corresponding latch on biasing member 120. Of course, reactive member 110 and biasing member 120 may be in opposite positions. Similarly, other selective engaging devices, such as a sensor and engaging transducer, adhesives, magnets, lock-and-key devices, etc., may be placed on foundation 2000 and/or structure 1000 to hold structure 1000 to foundation 2000 or dampen reactive movement of structure 1000 following a displacement of structure 1000 across distance d. Springs, foams, rubber bearings, and other plastic or elastic members may be used in example embodiment lateral dampening device 100, alone or in combination with biasing member 120 and reactive member 110, to reduce both initial and reactive movement in structure 1000.

By setting d to be a displacement encountered only in an aircraft strike or other event of interest, for example, setting d to be over 50 inches for a typical aircraft strike from the UCB report, example embodiment lateral dampening devices 100 may engage and prevent reactive movement only in an aircraft strike scenario, when a single, immediate, substantial recoil in structure 1000 is expected. In this way, in an earthquake with several diminishing oscillating displacements, example embodiment lateral dampening devices may not engage and hold structure 1000 to foundation 2000. It is understood that other distances d may be set based on the expected difference between an earthquake expected for a particular structure and airstrike on a given structure, so as to effectively differentiate between and response to unique characteristics of both scenarios as they are anticipated to actually occur. Expected earthquake characteristics may be precisely determined from seismic activity reports, historic earthquake data, and/or fault analysis that accounts for relevant parameters such as fault type, soil conditions, building parameters, etc. to effectively determine maximum base displacement during the expected earthquake.

As shown in FIG. 3, example embodiment systems may include example embodiment seismic bearings 200 connected, rigidly or moveably, between foundation 2000 and structure 1000. Example embodiment seismic bearings 200 may include all structure and functionality of conventional seismic bearings 10 (FIGS. 1A & 1B) and/or be used in conjunction with example embodiment lateral dampening devices 100. Or, in addition, example embodiment seismic bearings 200 may include additional structure and functionality to provide additional damage prevention to structure 1000 in the case of displacement events such as a large jetliner impact on a lateral surface of structure 1000.

Figure 5A:
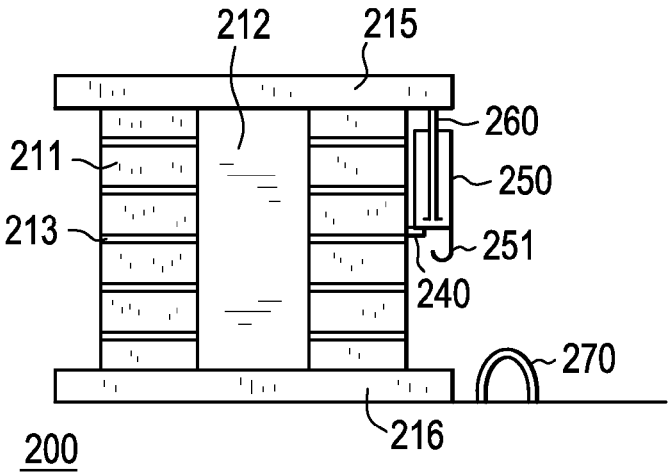
FIGS. 5A and 5B are illustrations of an example embodiment seismic bearing.

As shown in FIG. 5A, example embodiment seismic bearing 200 may include features of a conventional seismic bearing in addition to a capture assembly including differentiating post 240, inner shaft 260, outer shaft 250, hook 251, and/or stationary hoop 270. Inner shaft 260 may be attached to upper plate 215, and outer shaft 250 may be moveably slid over inner shaft 260 through a hole on an upper surface of outer shaft 250. Inner shaft 260 and outer shaft 250 may include flanges or other structures permitting their relative vertical sliding movement but preventing their total disconnection. In a default position shown in FIG. 5A, outer shaft 250 and inner shaft 260 may substantially overlap in a vertical position, with outer shaft 250 resting on differentiating post 240 connected to an annulus 211 of example embodiment seismic bearing 200.

Figure 5B:
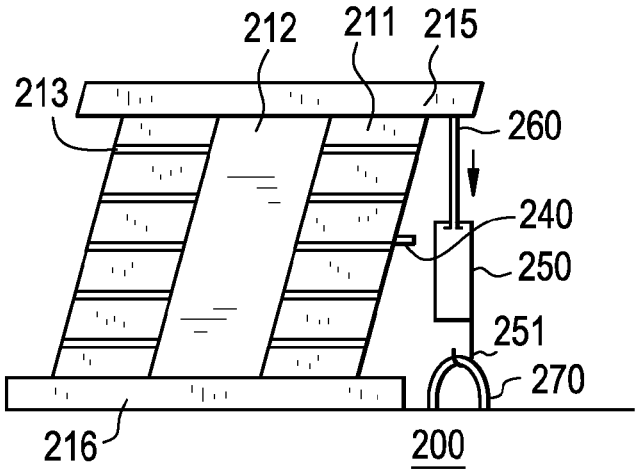

As shown in FIG. 5B, when upper plate 215 of example embodiment seismic bearing 200 moves a significant distance, such as in an aircraft strike event that significantly displaces structure 1000, outer shaft 250 moves horizontally off differentiating post 240. Outer shaft 250 may be horizontally joined with inner shaft 260, and/or a coefficient of friction between outer shaft 250 and differentiating post 240 may be sufficiently low to permit outer shaft 250 to move completely off of differentiating post 240 following a large, sudden horizontal shift encountered in an aircraft strike event. Because of the vertically movable relationship between outer shaft 250 and inner shaft 260, outer shaft 250 may fall downward after moving off differentiating post 240. When outer shaft 250 falls downward, hook 251 may engage a stationary hoop 270 that may be affixed to foundation 2000 or another massive stationary structure. As shown in FIG. 5B, once hook 251 and hoops 270 are engaged, inner shaft 260, outer shaft 250, and hook 251 may prevent or dampen reactive displacement of upper plate 215 in an opposite direction.

A length of differentiating post 240 may be chosen to cause outer shaft 250 to drop only in instances of large displacements, such as in aircraft strike events. For example, knowing an overall height and deformation profile of example embodiment seismic bearing 200, differentiating post 240 may be given a length that will cause outer shaft 250 to drop only after upper plate 215 suddenly and initially moves around 50 inches or more, characteristic of an aircraft impact. In this way, hoop 270 may catch hook 251 and provide additional reactive movement dampening only in a non-earthquake scenario, where subsequent structural reactions may be especially destructive unless prevented or reduced by example embodiment systems and devices. Of course, example embodiment seismic bearing 200 may also function identically to conventional seismic bearings in the instance of an earthquake event, providing unique earthquake and aircraft impact responses based on the different reactions to these events.

Example embodiment seismic bearing 200 shown in FIGS. 5A and 5B may be fabricated of any resilient or plastically-deforming material that absorbs a desired level of energy or prevents a desire amount of movement in structure 1000. Although example embodiment seismic bearing 200 is shown in FIGS. 5A and 5B using a capture assembly including outer shaft 250, inner shaft 260, hook 251, and differentiating post 240, it is understood that other structures may provide the desired aircraft-impact-specific engagement and mitigation. For example, magnets, adhesives, lock-and-key relationships and other structures may be used to provide any desired type and amount of joining and/or securing of example embodiment seismic bearings 200 to a stationary base such as foundation 2000 to prevent or reduce damage to structure 1000.

Figure 6A:
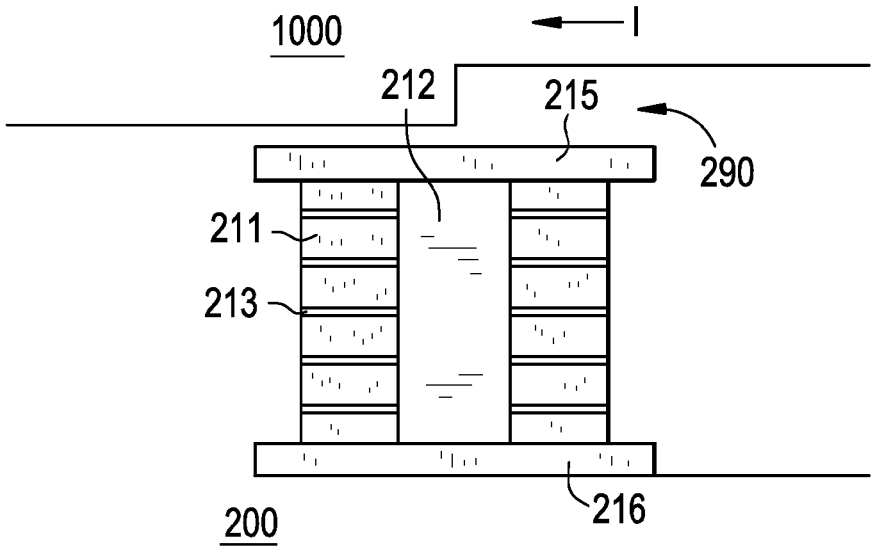
FIGS. 6A and 6B are illustrations of a further example embodiment seismic bearing.
Figure 6B:
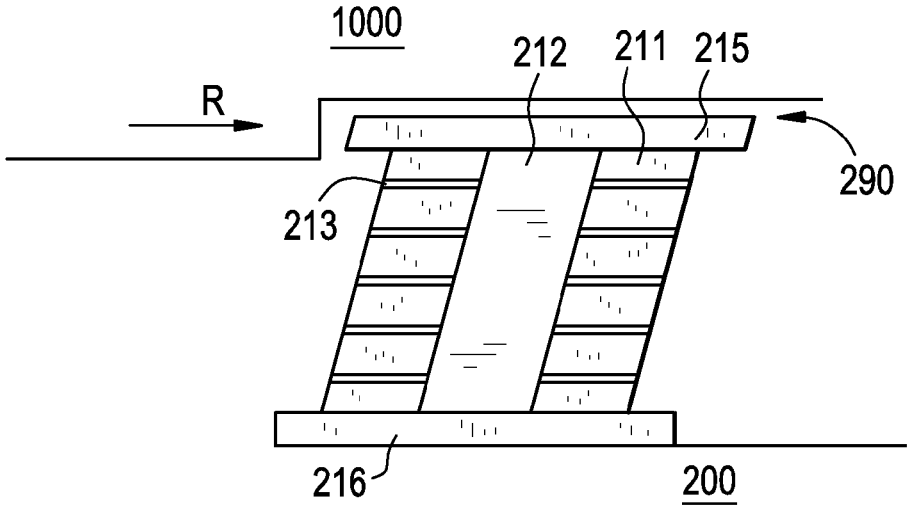

FIG. 6A is an illustration of another example embodiment seismic bearing 200, useable in combination with the example embodiment system of FIG. 3 and any other features of example embodiment seismic bearings 200 of FIGS. 5A and 5B. As shown in FIG. 6A, example embodiment seismic bearing 200 may be configured substantially similarly to conventional seismic bearing 10 (FIGS. 1 & 1A), except for a relationship between top plate 215 and a base of supported structure 1000. A capturing feature, such as a divot or ledge 290, is formed in structure 1000 near an upper plate 215 of example embodiment seismic bearing 200. A length of top plate 215, position of ledge 290, and/or separation or coefficient of friction between top plate 215 and base of structure 1000 are matched such that when structure 1000 undergoes an initial dramatic displacement I, top plate 215 will seat into, or otherwise catch or be fixed to, ledge 290. As shown in FIG. 6B, when structure begins reactive movement R, example embodiment seismic bearing 200 absorbs additional energy and dampens movement of structure 1000 in the R direction.

Example embodiment seismic bearing 200 shown in FIGS. 6A and 6B may be configured to selectively engage and provide additional reactive dampening during an aircraft strike event. For example, during an earthquake causing several smaller oscillations between foundation 2000 and structure 1000, example embodiment seismic bearing 200 may provide smaller energy absorption and dampening, due to either a lower coefficient of friction or separation between upper plate 215 and a base of structure 1000, when upper plate 215 does not engage into ledge 215. During an aircraft impact, when initial, sudden displacement I is significantly larger in structure 1000, plate 215 and ledge 290 may selectively engage, and an abutting of lateral surfaces of ledge 290 and upper plate 215 may cause example embodiment seismic bearing 200 to provide additional energy absorption and dampening of structure 1000 in the R direction. In this way, ledge 290 and engaged example embodiment seismic bearing 200 may provide additional reactive movement dampening only in an impact scenario, where subsequent structure reactions may be especially destructive unless prevented or reduced by example embodiment systems and devices. Of course, example embodiment seismic bearing 200 may also provide some conventional seismic bearing functionality in the instance of an earthquake event, providing unique earthquake and aircraft impact responses based on the different reactions to these events.

Although example embodiment seismic bearing 200 is shown in FIGS. 6A and 6B using a ledge 290 capturing top plate 215, it is understood that other structures selectively locking example embodiment seismic bearings and structures may provide the desired aircraft-impact-specific engagement and mitigation. For example, sensor-operated transducers, adhesives, lock-and-key relationships and other structures may be used to provide any desired type and amount of joining and/or securing of example embodiment seismic bearings 200 to structure 1000.

Figure 1B:
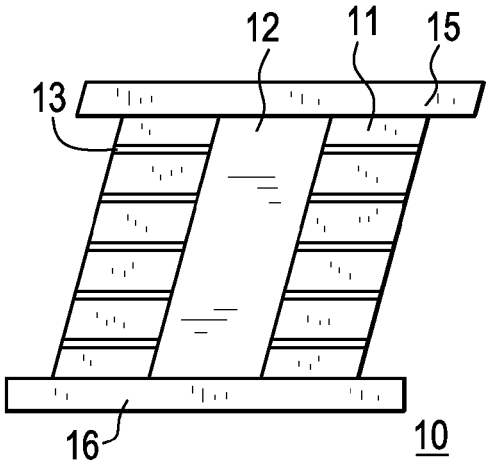
FIG. 1B (Conventional Art)

Each other component of example embodiment seismic bearings 200, including lower plate 216, core post 212, annulus 211, and plates 213, may be configured similarly to conventional seismic bearings 10 (FIGS. 1A & 1B). Alternatively, any of lower plate 216, core post 212, annulus 211, and plates 213 may be reconfigured or omitted in example embodiment seismic bearings 200. For example, height of core 212 and annuluses 211 may be modified to achieve a desired overall example embodiment seismic bearing 200 height most compatible with achieving differentiating post 240's function or permitting a desired degree of displacement resistance and rigidity. Or, for example, lower plate 216, post 212, annuluses 211, and plates 213 may be thickened on a single side or fabricated of varying materials in order to provide additional movement dampening and energy absorption for displacement in a single direction, such as displacement experienced after upper plate 215 seats into ledge 290 in FIGS. 6A and 6B, for example. In this way, example embodiment seismic devices 200 may further be configured to specifically address and mitigate damage caused by non-seismic events with more severe and immediate reaction profiles in structure 1000.

Thus, through the use of various example embodiment seismic bearings 200 and/or lateral dampening devices 100 in example embodiment systems, such as the system of FIG. 3, example embodiments provide conventional seismic isolation and protection while additionally providing selective and unique functionality and structure that mitigates damage caused by more extreme events, including direct impact events. Example embodiment lateral dampening devices 100 and seismic bearings 200 may be fabricated from conventional apparatuses or devices having additional structures to combat aircraft impact damage, so as to reduce the cost and complexity of example embodiment devices and permit use of example embodiment devices with existing seismic countermeasures. Similarly, example embodiment devices and systems are useable in any number and combination for any structure, to provide protection to the structure in both earthquake and impact events. For example, only example embodiment seismic bearings 200 may be employed in example systems if an embedding foundation 2000 is not available for example embodiment lateral dampening device 100 use. While example embodiments have been described used with a generic structure 1000, it is understood that structure may be any specific structure requiring critical seismic and impact protection, such as nuclear reactor containment buildings, high-rise commercial buildings in high-density city zoning, strategic weapons silos, critical infrastructure, etc., the structure may also be any specific structure without such critical significance, including houses, factories, stadiums, etc.

Example embodiments thus being described, it will be appreciated by one skilled in the art that example embodiments may be varied through routine experimentation and without further inventive activity. Variations are not to be regarded as departure from the spirit and scope of the exemplary embodiments, and all such modifications as would be obvious to one skilled in the art are intended to be included within the scope of the following claims.

What is claimed is:

1. A system for mitigating structural damage from impact events, the system comprising:

a lateral dampening device extending between a side of a structure and a lateral foundation, the side of the structure being separated from the lateral foundation, the lateral dampening device including a reactive member and a restorative member, the reactive member mounted on one of the side of the structure and the lateral foundation, the restorative member mounted on an other of the side of the structure and the lateral foundation, the lateral dampening device: configured to shift from a disengaged state to an engaged state in response to an initial displacement caused by one or more of the impact events, the disengaged state being where the side of the structure and the lateral foundation are not joined by the lateral dampening device in that the reactive member is spaced from the restorative member, the engaged state being where the side of the structure and the lateral foundation are joined and held together by the reactive member and restorative members of the lateral dampening device, the lateral dampening device structured to maintain the engaged state during an opposite, reactive displacement following the initial displacement; and a seismic bearing connected between a base of the structure and a base foundation.

2. The system of claim 1, wherein a plurality of the lateral dampening devices are positioned at vertical intervals along at least one of the side of the structure and the lateral foundation.

3. The system of claim 1, wherein the restorative member and the reactive member are configured to rigidly join the structure and the lateral foundation in a first direction when the structure moves a distance in a second direction opposite the first direction.

4. The system of claim 3, wherein the distance is a predetermined distance greater than a distance the structure moves in the first direction during an expected earthquake.

5. The system of claim 3, wherein the distance is greater than approximately 50 inches.

6. The system of claim 3, wherein the restorative member includes a spring, and wherein the reactive member includes a biasing surface on the structure and a hook on the lateral foundation, the hook configured to rigidly engage the biasing surface when the structure moves the distance.

7. The system of claim of claim 1, wherein the seismic bearing includes a top plate connected to the base of the structure, a bottom plate connected to the base foundation, and a resistive core connected between the top plate and the bottom plate configured to dampen relative movement between the structure and the base foundation.

8. The system of claim 7, wherein the seismic bearing further includes a capture assembly configured to rigidly join the structure and the base foundation in a first direction when the structure moves a distance in a second direction opposite the first direction.

9. The system of claim 8, wherein the distance is a predetermined distance greater than a distance the structure moves in the first direction during an expected earthquake.

10. The system of claim 8, wherein the distance is greater than approximately 50 inches.

11. The system of claim 8, wherein the capture assembly includes an inner shaft connected to the top plate, an outer shaft vertically slidably attached to the inner shaft in a vertical direction, a hook on the outer shaft, a differentiating post attached to the resistive core, and a stationary hoop rigidly attached to the base foundation.

12. The system of claim 11, wherein the outer shaft is configured to rest on the differentiating post until the structure moves the distance, and wherein the outer shaft is configured to vertically extend so that the hook engages the stationary hoop when the structure moves the distance to achieve the rigid joining.

13. The system of claim 1, wherein the base of the structure includes a ledge about the seismic bearing, and wherein the seismic bearing includes a top plate, a bottom plate connected to the base foundation, and a resistive core connected between the top plate and the bottom plate configured to dampen relative movement between the structure and the base foundation.

14. The system of claim 13, wherein the top plate is configured to seat into the ledge and dampen movement between the structure and the base foundation in a first direction when the structure moves a distance in a second direction opposite the first direction.

15. The system of claim 14, wherein the distance is a predetermined distance greater than a distance the structure moves in the first direction during an expected earthquake.

16. The system of claim 14, wherein the distance is greater than approximately 50 inches.

17. The system of claim 1, wherein the structure is a containment building of a nuclear reactor.

18. The system of claim 1, wherein the side and the base of the structure are defined by different planes.

19. The system of claim 1, wherein the side of the structure is substantially parallel to the lateral foundation.

20. The system of claim 1, wherein the lateral dampening device is arranged above the seismic bearing.

21. A lateral dampening device for mitigating structural damage from impact events, the lateral dampening device comprising:

a restorative member configured to be mounted on one of a lateral foundation and a side of a structure; and a reactive member configured to be mounted on an other of the lateral foundation and the side of the structure, the reactive member configured to mate with the restorative member so as to join the lateral foundation and the side of the structure, the reactive member configured to join the structure and the lateral foundation in a first direction when the structure moves a distance in a second direction toward the lateral foundation opposite the first direction, wherein the lateral dampening device is configured to shift from a disengaged state to an engaged state in response to an initial displacement caused by one or more of the impact events, the disengaged state being where the side of the structure and the lateral foundation are not joined by the lateral dampening device, the engaged state being where the side of the structure and the lateral foundation are joined and held together by the lateral dampening device, the lateral dampening device structured to maintain the engaged state during an opposite, reactive displacement following the initial displacement.

22. A seismic bearing for mitigating structural damage from impact events, the seismic bearing comprising:

a top plate configured to connect to a structure;

a bottom plate configured to connect to a base foundation;

a resistive core connected between the top plate and the bottom plate configured to dampen relative movement between the top plate and the bottom plate; and a capture assembly including, an inner shaft connected to the top plate, an outer shaft vertically slidably attached to the inner shaft in a vertical direction, a differentiating post attached to the resistive core, and a joining device configured to rigidly join the outer shaft to the base foundation when the top plate moves a distance.

23. The seismic bearing of claim 22, wherein the joining device rigidly joins the structure and the base foundation in a first direction when the structure moves the distance in a second direction opposite the first direction.

* * * * *